United States Patent [19]

Raymond

[11] Patent Number: 4,629,404

[45] Date of Patent: Dec. 16, 1986

[54] NUTATING DISC TYPE FLUID DEVICE

[76] Inventor: Charles Raymond, 1715 Mountain View Ave., Petaluma, Calif. 94952

[21] Appl. No.: 747,052

[22] Filed: Jun. 20, 1985

[51] Int. Cl.[4] ..... F01C 1/063

[52] U.S. Cl. ..... 418/49; 418/50; 418/52

[58] Field of Search ..... 418/49–53, 418/28, 68, 192, 193, 152

[56] References Cited

U.S. PATENT DOCUMENTS

| | | | |
|---|---|---|---|
| 527,538 | 10/1894 | Nash | 418/50 |
| 1,848,419 | 3/1932 | Gamon | 418/50 |
| 2,982,222 | 5/1961 | Ball | 418/53 |
| 2,997,000 | 8/1961 | Becker | 418/53 |
| 3,816,039 | 6/1974 | Berry | 418/68 |
| 4,373,882 | 2/1983 | Ladusaw | 418/270 |

*Primary Examiner*—Leonard E. Smith

*Assistant Examiner*—Jane E. Obee

*Attorney, Agent, or Firm*—Flehr, Hohbach, Test, Albritton & Herbert

[57] ABSTRACT

A nutating disc type fluid device in which in one embodiment nutating elements are mounting within a single chamber of a housing on a common shaft in a manner which is dynamically and pressure balanced. A divider plate is fitted through slots formed on one side of each nutating element so that relative rotation between the shaft and housing creates successive expanding and contracting volumes to draw fluid into the chamber through inlet ports and to exhaust fluid through outlet ports. The ports are sized and shaped to provide maximum and constant fluid flow. In another embodiment the nutating disc element is formed of an elastomeric material which permits unimpeded passage of solid objects that may be entrained in the fluid.

15 Claims, 5 Drawing Figures

NUTATING DISC TYPE FLUID DEVICE

This invention relates to nutating disc type fluid devices for use in applications such as pumping fluids, as hydraulic motors, for compressing gasses, or as a vacuum source and the like.

Nutating disc type fluid devices have previously been provided for various applications. A typical application is a nutating disc gas meter. Nutating disc designs have also been previously suggested for use as hydraulic pumps and motors, but these designs have a number of disadvantages and limitations. For example, previous designs for nutating disc type pumps and motors have not been capable of providing large flow rates in relation to their size, and their input/output power ratings have therefore also been relatively low. The previous designs in general create fluid sealing problems, operate with dynamic and pressure imbalance, cannot effectively pass solid objects entrained in the fluids, and the discs undergo extreme angular acceleration loads during their nutating movement.

It is a principal object, therefore, of the present invention to provide a nutating disc type fluid device which obviates the disadvantages and limitation of previous devices of this type.

Another object of the invention is to provide a nutating disc type fluid device with improved operating characteristics including relatively larger fluid flow rates and power ratings with constant flow velocity.

Another object is to provide a nutating disc type fluid device of the type described which is simplified in design and construction with a relatively few number of moving parts and which is of robust construction providing a long operating life under adverse conditions.

Another object is to provide a nutating disc type fluid pump/motor device of the type described which is capable of pumping a wide range of different types of fluid including fluids that contain solid foreign objects which would otherwise damage the pump or impair operation of the moving parts.

The fluid device of the invention comprises a housing which defines a chamber through which a shaft is mounted for relative rotation. In one embodiment a pair of nutating elements are mounted on the enlarged ball portion of a shaft for relative rotation about respective axes which intersect at the center of the chamber. A divider plate carried by the housing extends radially into one side of the chamber and is slidably fitted into slots formed in the nutating elements. Inlet and outlet ports are formed in the housing on opposite sides of the divider plate. Relative rotation between the shaft and housing causes the elements to undergo nutating movement to create successive expanding and contracting volumes within the chamber for moving the fluid between the inlet and outlet ports. In another embodiment the nutating element is formed of an elastomeric material which resiliently deforms to permit passage of foreign objects carried by the fluid.

The foregoing and additional objects and features of the invention will appear from the following description in which the several embodiments have been set forth in conjunction with the accompanying drawings.

Figure 1:
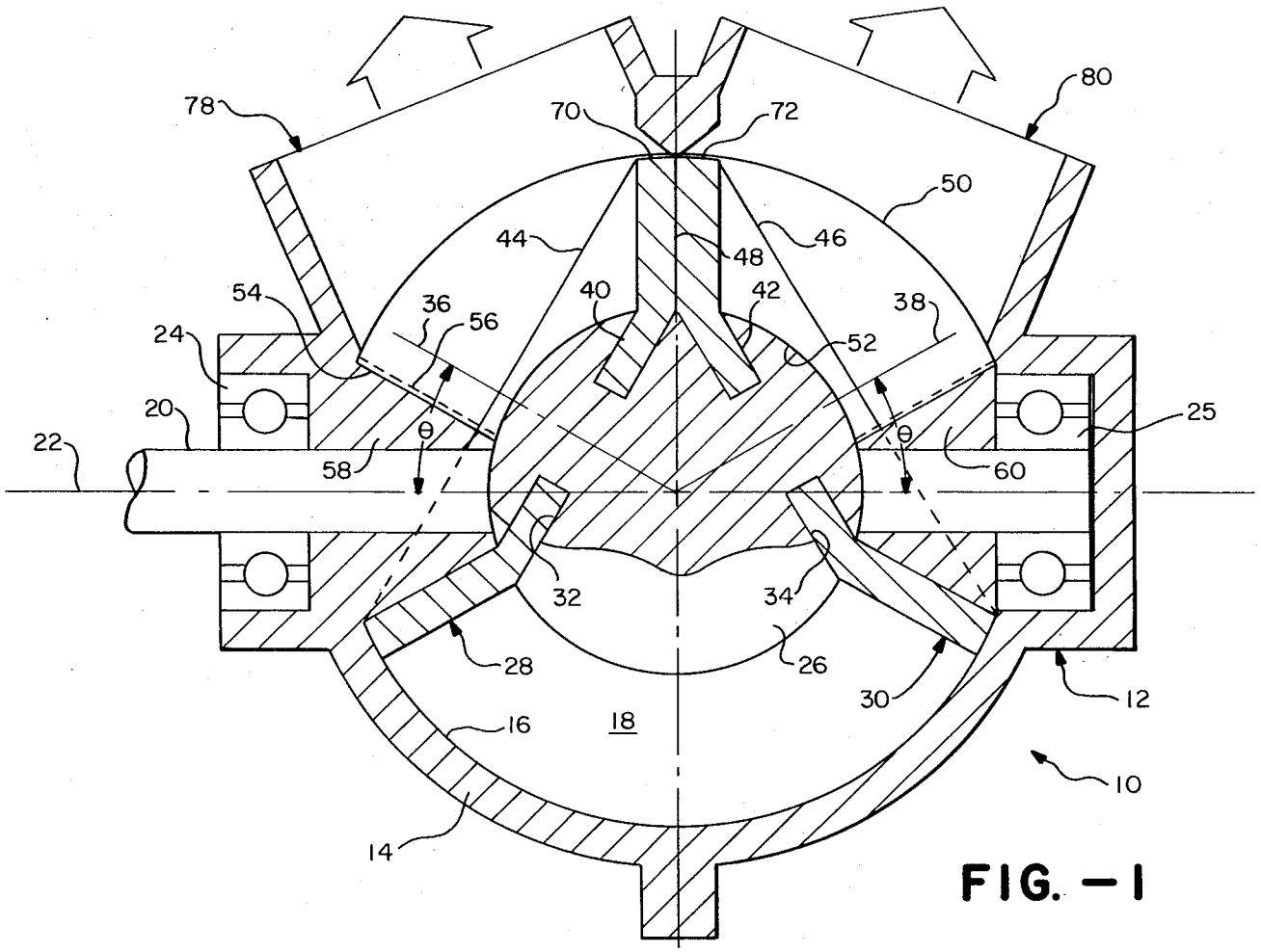
FIG. 1 is an axial section view of a fluid device according to one embodiment of invention.
Figure 2:
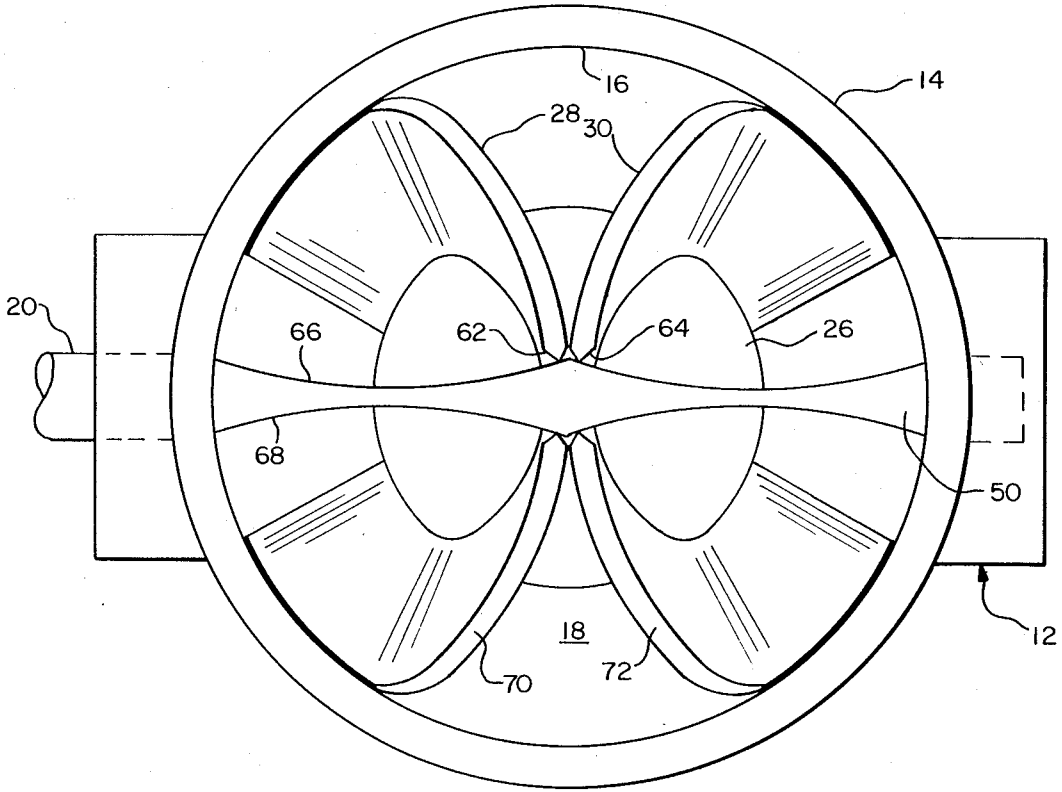
FIG. 2 is a top plan view, partially broken away, of the fluid device of FIG. 1.
Figure 3:
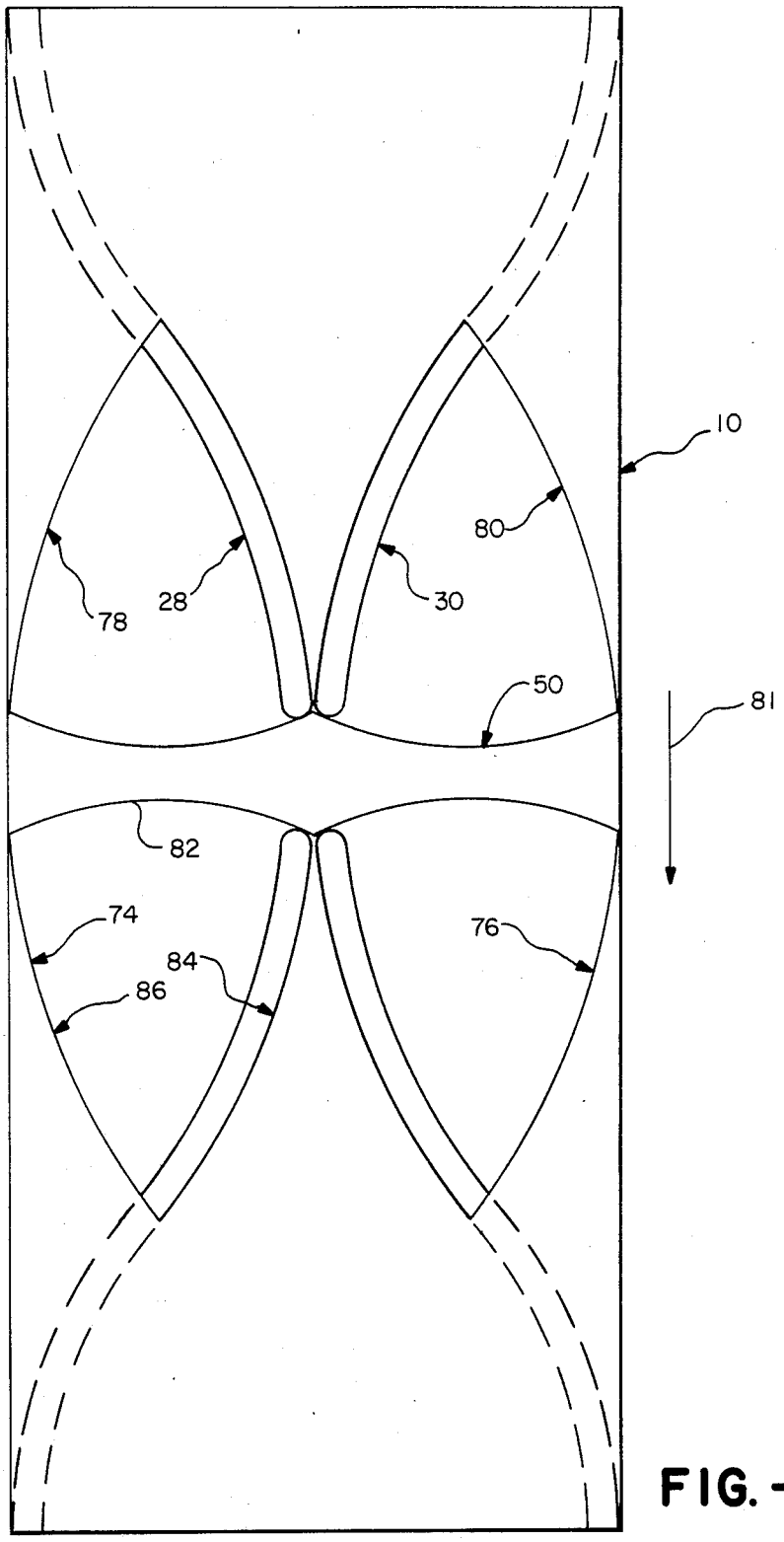
FIG. 3 is a developmental view showing the porting arrangement and positioning of the edge of the nutating elements throughout 360° of travel.

In the drawings FIGS. 1–3 illustrate a preferred embodiment of the invention providing a nutating disc type fluid device 10 for use as an hydraulic pump or motor employing a relatively incompressible working fluid such as water or oil, and including highly viscous liquids such as molasses and the like. As explained below the invention also has application with compressible fluids such as for compressing gasses or in providing a vacuum source.

Fluid device 10 comprises a housing 12 having an outer wall 14 formed with an interior spherical surface 16 which defines a working chamber 18. A shaft 20 is mounted in the chamber along a central axis 22 which extends through the center of the sphere forming the chamber. The shaft and housing are mounted for relative rotation by means of a pair of anti-friction bearings 24, 25. In the illustrated embodiment housing 12 is stationary to function as a stator with the shaft rotating. Depending upon the particular requirements and specifications, the shaft could be stationary with the housing rotating about it, such as in the application of the device as an hydraulic wheel motor. For use as fluid pump the rotating element, either the shaft or housing, would be driven from an external power source by a suitable drive train, not shown. When utilized as an hydraulic motor where the inlet fluid is pressurized, power would be taken from the rotating element, either the shaft or housing as the case may be, by a suitable drive train.

An enlarged ball 26 having a spherical surface centered withing the chamber is carried on the shaft 20. The ball can be formed integral with the shaft or it can be a separate part keyed on the shaft. The ball carries a pair of nutating elements 28, 30 which function in the manner of nutating discs. Journal bearing means comprising circular slots 32, 34 are formed in the ball to mount the nutating elements for rotation about respective axes 36, 38 which intersect at the center of the chamber and which also define acute angles $\theta$, shown as 30°, with respect to the central axis of the shaft. Each element is formed with a flat annular base 40, 42 which rotates within a respective bearing slot. The outer rims 44, 46 of each element are in the shape of a conical section, and the nutating elements are sized and positioned so that on one side of the chamber adjacent portions of the conical sections are in rolling contact along a radial line 48 which is in a plane perpendicular to the shaft. Thus, in the position of the elements shown in FIG. 1 the line of rolling contact is at the top of the chamber. This line of rolling contact rotates about the chamber in phase with and in the direction of rotation of the shaft. An important feature of the invention is that the line of rolling contact provides a common fluid seal between the two nutating elements. This eliminates the requirement of separate seals along opposite sides of the nutating disc as in previous pumps and meters of this type.

A crescent-shaped divider plate 50 is carried by the housing and projects radially into the chamber on one side of the shaft. The inner edge 52 of the divider plate is circular and is shaped to conform with the spherical surface of ball 26 for relative rotation therewith. The opposite radial edges 54 of the plate are fixedly mounted in radially extending shallow grooves 56 formed in the outer surface of a pair of end cones 58, 60 which project into the chamber from opposite ends of the housing. The inner conical surfaces of the nutating elements touch the end cones along rolling lines of contact which form fluid seals. Alternatively, the end cones would be mounted on or formed as integral parts of the shaft, and the end cones would turn in close sealing, relative movement with the radial edges of the divider plate.

Radial slots 62, 64 (FIG. 2) are formed on common sides of the conical portions of the respective nutating elements 28, 30 with the divider plate 50 fitted in the slots to permit back-and-forth movement of each element across one-half sector of the plate. The opposite sides 66, 68 of each half sector of the divider plate are outwardly concaval whereby the opposing radial edges of each of the slots 62, 64 form tangent seals at all positions of the elements during their back-and-forth movement to maintain a good fluid seal. The outer peripheral edges 70, 72 of the nutating elements are formed with spherical surfaces conforming with the interior spherical surface 16 of the housing to maintain a good fluid seal throughout the nutating motion of the elements within the chamber.

A pair of inlet ports 74, 76 and a pair of outlet ports 78, 80 are provided in the housing wall on opposite sides of divider plate 50. In the developmental view of FIG. 3 the direction of shaft rotation is from top to bottom as shown by the arrow 81. The inlet port 74 and outlet port 78 direct the fluid into and from the side of the chamber in which nutating element 28 operates, and from the opposite pair of inlet and outlet ports 76, 80 direct fluid into and from the side of the chamber in which the other nutating element 30 operates. An important feature of the invention is the novel configuration by which the port areas are capable of being sized to the full cross sectional area of the fluid flow through the two sides of the chamber. As best showing in the developmental view of FIG. 3 each of the ports is substantially triangular in shape. One side 82 extends the full width of the half sector of the divider plate across which the corresponding nutating element traverses. Each of the remaining sides of the triangular ports extend along the lines defined by the peripheral edge of nutating elements at the opposite limits of travel across the chamber. That is to say, for the inlet port 74 shown in FIG. 3 the inner edge 84 of the port extends along the line occupied by the edge of element 28 when the latter is at the far right of its position relative to divider plate 50, and this is the position illustrated for the elements in FIG. 1. The opposite edge 86 of the port extends along the line occupied by the edge of the element when moved to the opposite side of the chamber, and this would be the position where the side of the element is in contact with the conical surface of end cone 58 at the left end of the chamber as viewed in FIG. 1. Another important aspect of the inlet and outlet port configuration is that the ports provide automatic valving of the flow due to movement of the nutating elements across the port areas. This eliminates the requirement for separate valve elements and also eliminates the requirement ing, the coaction of the nutating elements 28, 30 with the rotating ball portion 26 and with divider plate 50 causes the elements to nutate back-and-forth within chamber 18 while also rotating within the slots 32, 34 of the ball about their respective axes. The nutating movement of the elements creates successive contracting and expanding volumes between the conical sections 58, 60 of the elements, the interior surface 16 of the housing and the outer surface of ball portion 26. Fluid is drawn through inlet ports 74, 76 into each side of the chamber and is forced under pressure by the nutating elements in a path around the chamber for exhausting through outlet ports 78, 80. The outlet ports can be connected through suitable conduits, not shown, with the desired end use application such as a fluid motor or hydraulic actuator.

The relatively large cross sectional areas of the inlet and outlet ports achieves a relatively large fluid flow at a constant flow velocity to achieve a large power rating for the pump. With the two nutating elements conjointly moving in opposing relationship within a single chamber, dynamic forces are in balance and the relatively large fluid pressures on the elements are also in balance.

The provision of mounting opposing nutating elements within a single chamber also permits the included angle $\theta$ to be one-half of the included angle required for a single disk with the same displacement. This smaller angle $\theta$ results in low order angular acceleration forces on the elements during their nutating movements.

Figure 4:
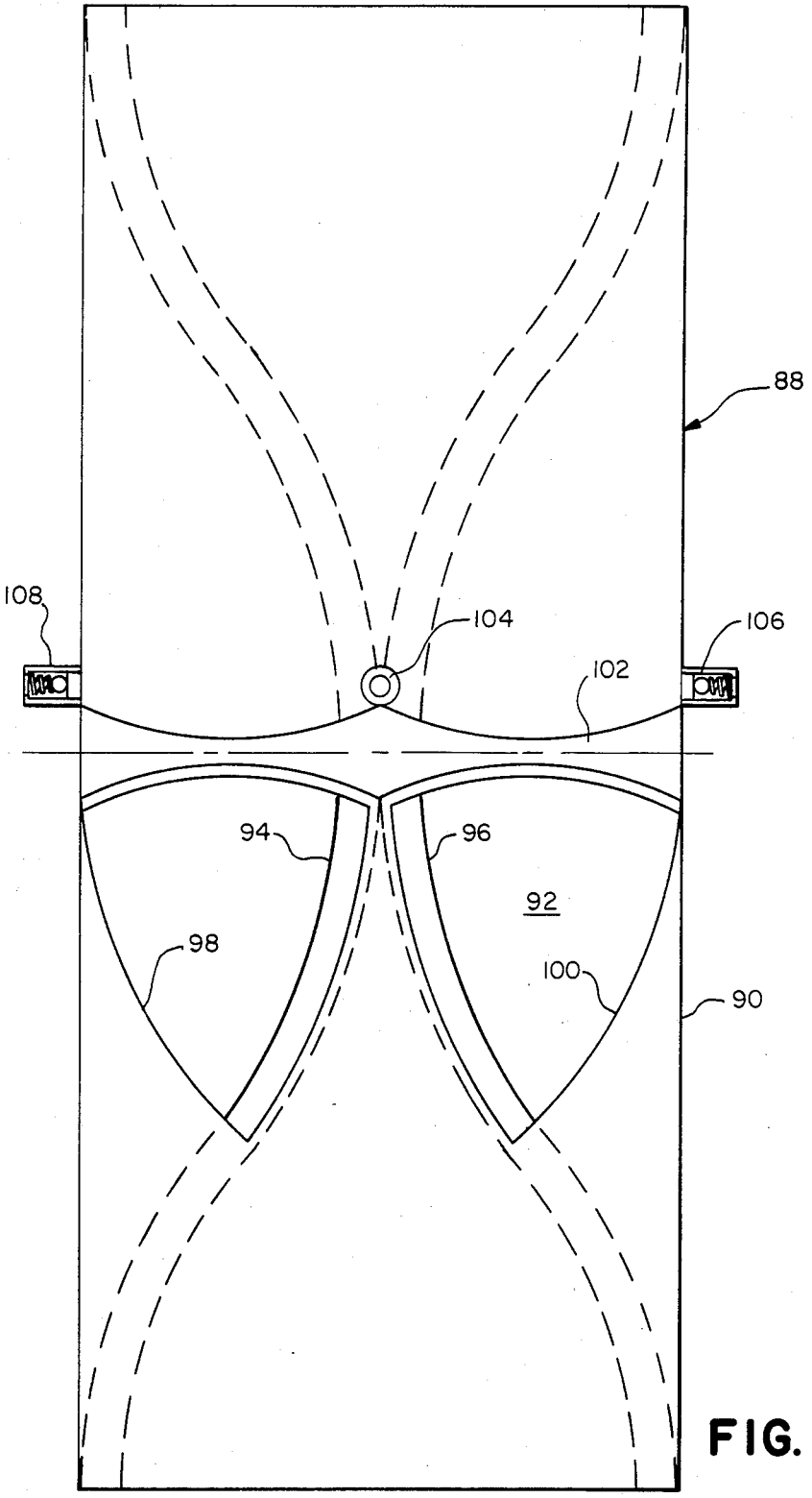
FIG. 4 is a developmental view similar to FIG. 3 showing the porting arrangement for another embodiment of the invention.

FIG. 4 illustrates a developed view of a fluid device 88 providing an embodiment of the invention for use as a gas compressor. In this embodiment the fluid device comprises a housing 90 defining a chamber 92 into which a pair of nutating elements 94, 96 are carried on a rotating shaft, not shown, similar in construction and assembly to the embodiment of FIGS. 1–3. A pair of full size inlet ports 98, 100 are provided on one side of a divider plated 102 in a manner similar to the embodiment of FIGS. 1–3. In place of full size outlet ports the fluid outlet means comprises a plurality of one way check valves 104, 106 and 108 mounted in the housing and communicating with the chamber on a common side of the divider plate. One of the check valves 104 is positioned on a side of the center of the divider plate at approximately the position where the nutating elements are in rolling contact at their inward extremity of travel, shown in FIG. 1, for discharging the gas that is compressed in the contracting volume between the inner surfaces of the nutating elements. Additional check valves 106, 108 are mounted in the housing at opposite ends of the divider plate at the position occupied by the nutating elements at their opposite extremities of travel.

Figure 5:
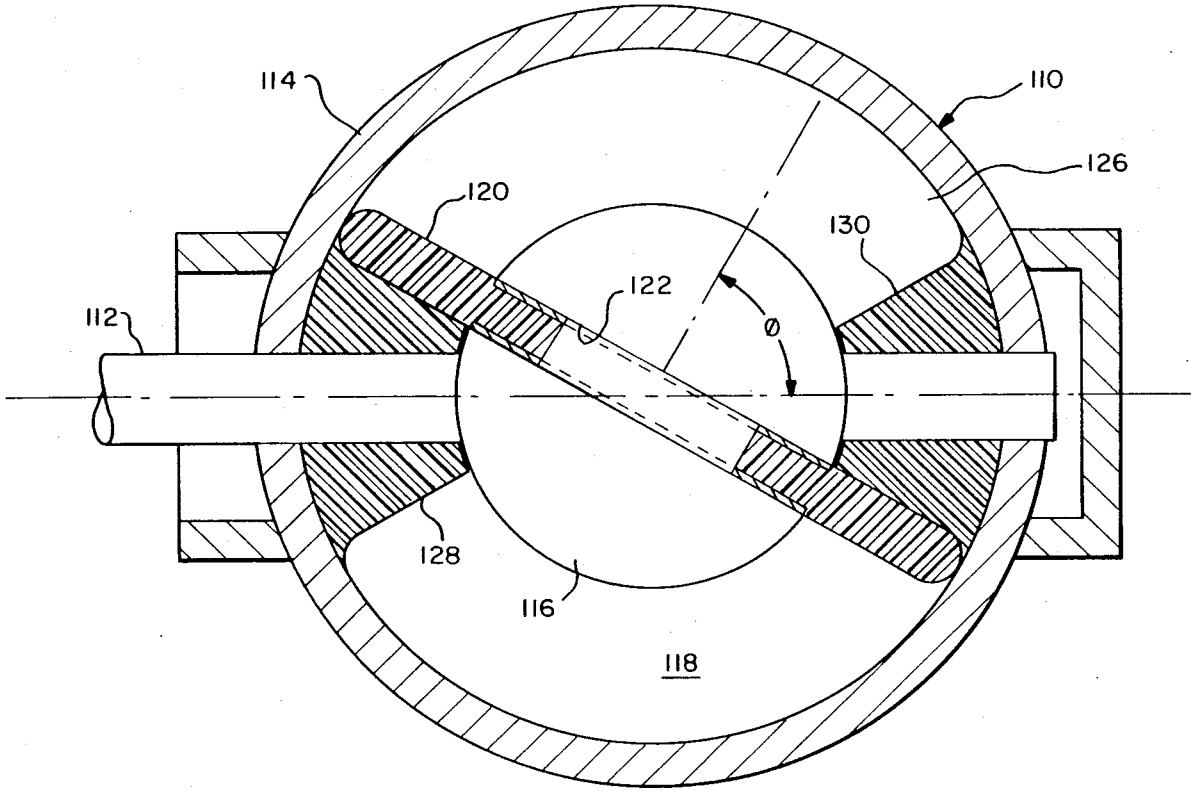
FIG. 5 is an axial section view of another embodiment of the invention.

FIG. 5 shows another embodiment of the invention providing a nutating disc type fluid device 110 for use with fluids that may contain solid objects such as sand or pebbles or other debris. In this embodiment a shaft 112 is mounted for relative rotation within a housing 114 of the type described for the embodiment in FIGS. 1–3. An enlarged ball 116 is formed on the shaft and is centered within the housing chamber 118. A single nutating disc 120 is mounted for rotation within a circular slot 122 formed in the ball about an axis 124 interfaces of the divider plots preferably would be outwardly concave, similar to the embodiment of FIGS. 1–3.

A pair of end cones 128, 130 project inwardly from opposite sides of the housing, and the opposing surfaces of the disc are in rolling contact at the interface with the surfaces of the cones to form fluid seals. Nutating disc 120 is formed of a suitable elastomeric material, such as hard rubber, having sufficient stiffness to generate the required fluid pressure while at the same time providing resilient deformation so that the surface of the disc can yield to permit solid objects entrained by the fluid to pass through the interface between the disc and cone without damaging these elements. This can occur when any of the entrained solid objects are trapped between the disc and cone surfaces. The resiliency of the disc material permits its surface to yield and roll over the hard object without damage. As required, the end cones and/or the central ball could be made of a similar elastomeric material so that the cone and ball surfaces also yield when any solid objects are trapped at the rolling interface with the disc. The particular hardness of the disc, end cones and ball would depend on the use application. For example, typically a durometer hardness in the range of 50–100 would be suitable for average fluid pumping pressure. An added advantage in forming the disc element of an elastomeric is that it yields to acceleration loads as well as slot width requirements during the nutating movement.

While the foregoing embodiments are at present considered to be preferred it is understood that numerous variations and modifications may be made therein by those skilled in the art and it is intended to cover in the appended claims all such variations and modifications as fall within the true spirit and scope of this invention.

What is claimed is:

1. A fluid device for use as a fluid pump or motor comprising the combination of a stator housing having an outer wall with an interior spherical surface which partially defines a chamber, a shaft extending through the chamber and mounted for rotation about a central axis, the shaft including an enlarged ball portion having a spherical surface concentric within the chamber, stator cones positioned about the shaft at opposite sides of the ball portion with the apexes of the cones extending toward the center of the chamber, a nutating disc having an outer circular edge conforming with the spherical surface of the housing, means for mounting the disc for rotation on the ball portion about an axis which extends through the center of the chamber and inclines at an acute angle with the central axis, said disc being formed of an elastomeric material which resiliently deforms to pass solid objects contained in the fluid and to accomodate slot width requirements during the nutating movement, a divider plate carried by the housing and extending radially into one side of the chamber with the inner edge of the divider shaped in conformance with the outer surface of the ball portion, and means forming a slot through one side of the disc with the divider plate slidably fitted in the slot.

2. A fluid device as in claim 1 in which the stator cones are formed of an elastomeric material which resiliently deforms to pass foreign objects contained in the fluid.

3. A fluid device as in claim 1 in which the ball portion is formed of an elastomeric material which resiliently deforms to pass foreign objects contained in the fluid.

4. A fluid device as in claim 1 in which the opposite sides of the divider plate are outwardly concaval whereby the edges of the disc slot form tangent seals with the divider plate sides at all positions of the disc.

5. A nutating disc type fluid device for use as a fluid pump or motor comprising the combination of a housing having an outer wall with an interior spherical surface which partially defines a chamber, a shaft extending through the chamber and mounted for rotation about a central axis, means for mounting the shaft and housing for relative rotation about the central axis, at least one nutating element formed with an outer peripheral edge shaped in conformance with the spherical surface of the housing wall for sliding movement therewith, means for mounting the nutating element for relative rotation with respect to the shaft about an axis which intersects the center of the chamber and which is at an acute angle with the central axis, a divider plate carried by the housing and extending through the chamber along one side of the shaft, means forming a slot radially through one side of the element with the divider plate slidably fitted through the slot, inlet port means for directing fluid into the chamber on one side of the divider plate and outlet port means for directing fluid from the chamber on the opposite side of the divider plate, said inlet port means comprising a triangular-shaped port opening having a base side which extends along the divider plate substantially the full lateral distance traveled by the peripheral edge of the element during nutating movement, and with each of the remaining sides of the opening extending along substantially the positions occupied by the peripheral edge of the element at its respective extreme opposite positions of travel within the chamber during nutating movement whereby a maximum inlet port area is provided in relation to the volume of fluid moving through the chamber.

6. A fluid device as in claim 5 in which the outlet port means comprises means forming a triangular-shaped port opening having a base side which extends along the divider plate substantially the full lateral distance traveled by the peripheral edge of the element during nutating movement, and with each of the remaining sides of the opening extending along substantially the positions occupied by the peripheral edge of the element at its respective extreme opposite positions of travel within the chamber during nutating movement whereby a maximum outlet port area is provided in relation to the volume of fluid moving through the chamber.

7. A fluid device for use as a pump, motor, gas compressor or vacuum source comprising the combination of a housing having an outer wall with a single interior spherical surface which partially defines a chamber, a shaft extending through the chamber along a central axis, an enlarged ball on the shaft with the ball and spherical chamber having a common geometric center, means for mounting the shaft and housing for relative rotation about the central axis, a pair of nutating elements each of which is formed with an outer peripheral edge shaped in conformance with the spherical surface of the housing wall for sliding movement therewith, means for mounting the nutating elements for relative rotation on the ball in planes offset from the geometric center, with the elements rotating about respective axes which intersect the center of the chamber and which extend in opposite directions at acute angles from the central axes with the elements abutting along common sides to form a fluid seal along a rolling line of contact, a divider plate carried by the housing and extending through the chamber along one side of the shaft, means forming slots radially through one side of each element with the divider slidably fitted through the slots, inlet port means for directing fluid into the chamber on one side of the divider and outlet port means for exhausting fluid from the chamber on the opposite side of the divider with the relative rotation between the shaft and housing causing nutating movement of the elements to produce alternate expanding and contracting volumes within the chamber.

8. A fluid device as in claim 7 in which the nutating elements are comprised of sections of cones having their apexes at the center of the chamber with the bases of the cones defining the sides which abut to form the fluid seal along the rolling line of contact.

9. A fluid device as in claim 7 in which the means for mounting the nutating elements for relative rotation includes journal bearings comprising circular slots formed in the ball concentric with the intersecting axes of the elements and with each element including an annular base mounted for relative rotation within a respective circular slot.

10. A fluid device as in claim 7 in which the nutating elements are formed of a material which provides rigidity for developing fluid pressure and which resilient deformation at the surfaces of the elements to permit passage through the chamber of solid objects contained in the fluid.

11. A fluid device as in claim 7 in which the housing is stationary and the shaft is mounted for rotation within the housing about the central axes.

12. A fluid device as in claim 7 in which opposite sides of the divider plate are outwardly concaval whereby the edges of the slots form tangent seals with the divider plate sides at all positions of the elements.

13. A fluid device as in claim 7 in which at least the inlet port means comprises means forming triangular-shaped port openings through the housing on a common side of the divider plate with each opening having a base side which extends along the dividers substantially the full lateral travelled by the associated nutating element and with each of the remaining sides of such triangular opening extending along substantially the position occupied by the peripheral edge of the element at its respective extreme opposite position of travel within the chamber whereby a maximum port area is provided in relation to the volume of fluid moving through the chamber.

14. A fluid device as in claim 13 for use as a gas compressor in which the outlet port means comprises one way valve means for directing compressed gas out of the housing from the volume of the chamber on the side of the divider plate which is opposite the inlet port means.

15. A fluid device as in claim 14 in which the one-way valve means includes at least one check valve in the housing at a location where the peripheral edges of opposing elements contact each other, together with additional check valves mounted at opposite sides of the chamber at locations where peripheral edges of the nutating elements are at their maximum distance apart.

* * * * *